United States Patent [19]

Schroeder

[11] Patent Number: 4,689,587

[45] Date of Patent: Aug. 25, 1987

[54] ELECTROMAGNETIC RELAY

[75] Inventor: Harry Schroeder, Unterhaching, Fed. Rep. of Germany

[73] Assignee: Siemens Aktiengesellschaft, Berlin and Munich, Fed. Rep. of Germany

[21] Appl. No.: 858,814

[22] Filed: May 2, 1986

[30] Foreign Application Priority Data

May 22, 1985 [DE] Fed. Rep. of Germany ..... 3518424

[51] Int. Cl.[4] ..... H01H 67/02

[52] U.S. Cl. ..... 335/128; 335/80; 335/85; 335/121

[58] Field of Search ..... 335/78, 80, 81, 85, 335/121, 124, 128, 281, 297

[56] References Cited

U.S. PATENT DOCUMENTS

| | | | |
|---|---|---|---|
| 3,688,229 | 8/1972 | Bloch | 335/128 |
| 4,182,998 | 1/1980 | Mueller | 335/153 |
| 4,472,699 | 9/1984 | Fujii | 335/85 |

FOREIGN PATENT DOCUMENTS 2115004 3/1971 Fed. Rep. of Germany .

*Primary Examiner*—E. A. Goldberg

*Assistant Examiner*—Lincoln Donovan

*Attorney, Agent, or Firm*—Hill, Van Santen, Steadman & Simpson

[57] ABSTRACT

An electromagnetic relay has a hollow coil having a magnet system forming a flux guidance loop in a circuit with a portion extending outside of and parallel to the coil, and another portion, formed by the armature, extending through the interior of the hollow coil. The loop is interrupted by a working air gap, which is slanted relative to the longitudinal axis of the coil, and which is completely encompassed within the interior of the coil. The air gap is formed by a wedge-shaped portion of the armature in registry with a wedge-shape pole piece. The slanted surfaces are longer in length than surfaces parallel to the coil axis, thereby providing a larger area for flux transfer through the air gap. Additionally, by slanting the flux transfer faces within the hollow coil, the overall size of the relay is not increased. The free end of the armature at which the flux transfer surface thereof is disposed as a continuation which engages a contact spring disposed at one end face of the coil body, for moving the contact spring with respect to one or more stationary contact elements for electrical connection and disconnection therewith.

8 Claims, 5 Drawing Figures

ELECTROMAGNETIC RELAY

BACKGROUND OF THE INVENTION

RELATED APPLICATION

This application is related to a co-pending application, filed simultaneously herewith, of the same inventor entitled "Electromagnetic Relay" and having Ser. No. 858,921.

FIELD OF THE INVENTION

The present invention relates to an electromagnetic relay having a coil with an axial opening extending thereto with an armature extending through the opening and a pole piece of a yoke also extending partially therethrough, the pole piece and the armature having flux guidance surfaces thereon disposed inside of the hollow coil forming a working air gap.

DESCRIPTION OF THE PRIOR ART

An electromagnetic relay having a coil member having an axial opening extending therethrough with a coil wound thereabout is described in German OS No. 2 115 004. This relay has an angled yoke with a first section extending into the axial opening of the coil body, and a second section extending perpendicularly to the coil axis to an end face of a first coil flange. The yoke has a third section extending parallel to the coil axis outside of the coil to a second coil flange. The relay has an armature at least partially disposed in the axial opening of the coil body, with the armature seated at the yoke in the region of the second coil flange and forming a working air gap in the axial opening with the first yoke section. The pole faces or flux guidance surfaces of the yoke and of the armature are disposed opposite to each other within the axial opening and are disposed obliquely relative to a longitudinal axis of the coil.

In this relay, the armature is mounted at a central region to the yoke so that, in addition to the oblique working air gap inside of the coil body, the armature forms a second air gap with the yoke outside of the coil body. This is intended to achieve a high response sensitivity for the electromagnetic system in the relay, however, this structure has the disadvantage that the armature therein can actuate a switch element only with a short leg thereof which extends outside of the coil body and perpendicular to the coil axis. Thus only a small working stroke can be achieved due to the short distance from the bearing location.

SUMMARY OF THE INVENTION

It is an object of the present invention to provide an electromagnetic relay having an armature extending through a hollow coil having a slanted surface forming a working air gap with a comparably slanted surface of a pole piece also extending into the coil opening which has a high response sensitivity while simultaneously having a relatively large armature stroke for contact actuation.

It is a further object of the present invention to provide such a relay system which is simple in structure and easy to assemble.

The above objects are inventively achieved in an electromagnetic relay wherein the armature extends in a longitudinal direction through the entire length of the axial opening in the coil body, with a bearing mount at one end, and with an opposite free end having a projection for actuating a contact spring moveable in a direction perpendicular to the coil axis. Engagement of the projection of the armature and the contact spring occurs in the region of a first coil flange, whereas the bearing mount of the armature is disposed at a second coil flange at an opposite end of the coil winding.

In this relay, therefore, the armature extends through the full length of the axial opening in the coil body, as well as through the entire length of the coil, with a bearing mount at one coil flange and a free end for actuating a contact spring at the other coil flange. The armature may be bar-shaped and seated at a yoke leg which is parallel to the coil axis. In another embodiment, the armature is angled so as to have a longer leg extending though the axial opening, and a shorter leg extending substantially perpendicularly with respect to the coil axis in front of the coil flange, which forms a bearing with a yoke leg proceeding parallel to the coil axis.

The armature or armature leg extending through the interior of the coil body along its full length has a wedge-like or tapered free end forming an obliquely proceeding flux guidance surface. This surface forms a working air gap with a correspondingly fashioned wedge-shaped pole piece or yoke leg. By appropriately selecting the length of the yoke leg, and thus the length of the working air gap in the axial direction of the coil, the attractive force of the magnet system can be set as desired. To obtain a defined point contact between the yoke leg and the armature, and thus to obtain defined force conditions, one embodiment of the relay has at least one of the flux guidance faces, either the face of the armature or the face of the yoke, or both, arced slightly convex in one direction. The pole face of the armature, for example, may be in the form of a convex arc in two directions. By appropriately shaping the convex arc, the contact point between the armature and the yoke or yoke leg can be displaced in the axial direction along the coil. The attractive force of the armature, that is, the excitation selected for generating a selected contact force, can be thus made lower as a result of the lengthened lever arm the further this contact point is disposed from the bearing location of the armature at the opposite coil end.

DESCRIPTION OF THE PREFERRED EMBODIMENTS

Figure 1:
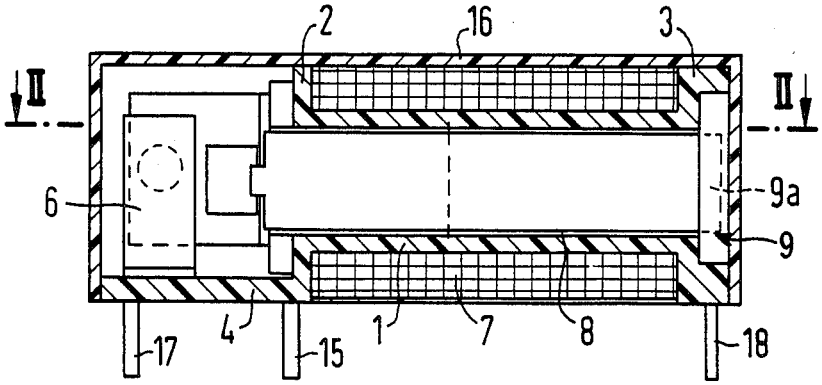
FIG. 1 is a side sectional view, taken along line I—I of FIG. 2, of an electromagnetic relay constructed in accordance with the principles of the present invention.
Figure 2:
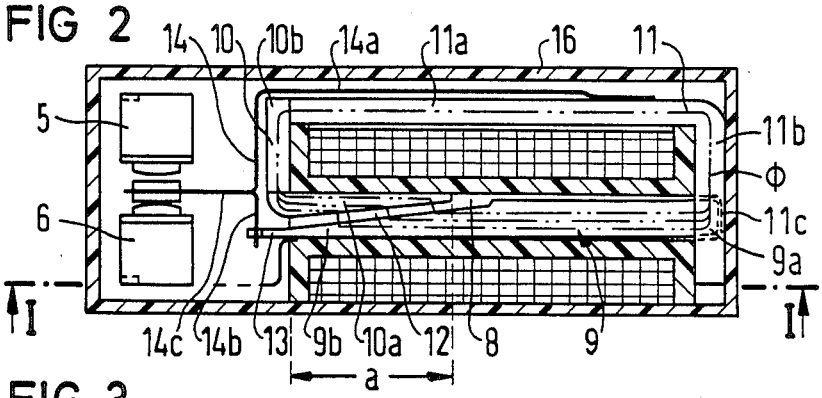
FIG. 2 is a plane sectional view taken along line II—II of FIG. 1.

A first embodiment of an electromagnetic relay constructed in accordance with the principles of the present invention is shown in FIGS. 1 and 2. The relay has a coil body 1 serving as a base body with two spaced flanges 2 and 3 forming opposite ends of the coil body 1. The flange 2 has an extension 4 in which two stationary contact elements 5 and 6 are anchored. The coil body 1 has a coil winding 7 wound about an axially extending opening in the coil body 1. A bar-shaped armature 9 extends through the axial opening parallel to the longitudinal axis of the coil. A two-piece yoke having an angled pole shoe 10 and an angled yoke member 11 forms an essentially rectangular flux guidance loop in combination with the armature 9 through the interior of the coil and around the exterior of the coil.

The angled pole shoe 10 forms a first yoke leg and has a wedge-shaped pole member 10*a* which, proceding from the coil flange 2, extends into the axial opening 8. The pole shoe 10 has a further portion forming a second yoke leg 10*b* disposed perpendicularly with respect to the coil axis at the end face in front of the flange 2. The angled yoke member 11 has a longitudinal leg 11*a* connected to the second yoke leg 10*b*. The longitudinal leg 11*a* serves as a third yoke leg extending parallel to the coil axis outside of the winding 7. The angled yoke member has a cross leg 11*b* serving as a fourth yoke leg which extends perpendicularly with respect to the coil axis at the end face in front of the flange 3. The fourth yoke leg 11*c* has a recess 11*c* for receiving a mounted end 9*a* of the armature 9 in a bearing. The armature end 9*a* is matched to the recess 11*c* in the form of a knife bearing or any other suitable bearing configuration, so that the armature 9 can execute switching motion toward and away from the pole shoe 10*a* at a free armature end 9*b*. The free armature end 9*b* is wedge-shaped in opposition to the pole shoe 10*a*, which is correspondingly wedge-shaped, and forms a working air gap 12 therewith. A projection 13 of the armature 9 engages a contact spring 14 at the free end 9*b* of the armature 9. The contact spring 14 has a fastening leg 14*a* disposed next to the yoke leg 11*a* and is secured thereto, and has an actuation leg 14*b* extending perpendicularly with respect to the coil axis in the direction toward the armature projection 13. A free end 14*c* of the actuation leg 14*b* forms a central contact which is switchable between the two stationary contact elements 5 and 6. A terminal element 15 for the contact spring 14 is attached to the contact spring leg 14*a* or to the angled yoke member 11.

Figure 3:
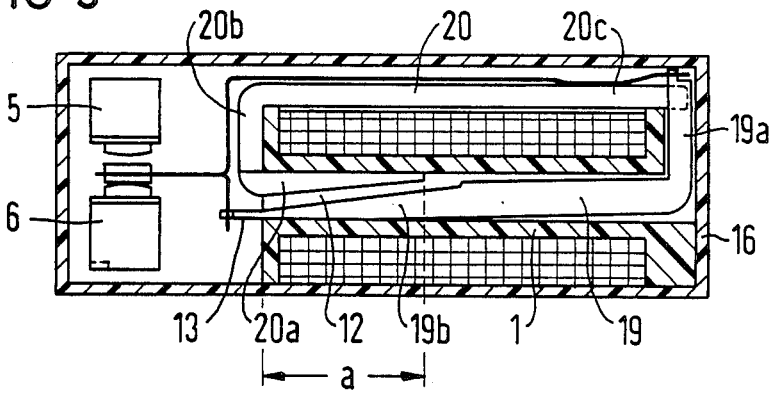
FIG. 3 is a plane sectional view of a further embodiment of the electromagnetic relay constructed in accordance with the principles of the present invention.

A modified embodiment of the relay is shown in FIG. 3. In this embodiment, the armature 19 is angled, having a bearing leg 19*a* extending perpendicularly with respect to the coil axis at the end face in front of the coil flange 3. The end of the leg 19*a* is seated at a yoke 20. In this embodiment, the yoke 20 has three legs, a wedge-shaped leg 20*a* functioning as a pole shoe, a cross-leg 20*b* disposed at the end face in front of the coil flange 2, and a longitudinal leg 20*c* having an end in the region of the coil flange 3 forming a bearing for the armature in combination with the armature bearing leg 19*a*. The bearing may be in the same form as described in the previous embodiment, such as a knife edge bearing or any other suitable configuration of mutually engaging components. The free end 19*b* of the armature 19 also forms a working air gap 12 in this embodiment as described above. The function of the contact spring 14 is the same as described in the previous embodiment.

In both embodiments, the relay is covered with a cover 16 and is sealed or cast as needed.

A relay may be constructed in accordance with the principles of the present invention in other configurations. For example, the magnet system can be rotated by 90° relative to the coil axis, in which case the cooperating contact elements must be differently shaped. In such a configuration, the terminal elements 15, 17 and 18 shown extending from the bottom of the relay in FIG. 1 would extend from one side of the relay (toward the reader out of the plane of the drawing in FIG. 1) and would then be visible at the lower portions of FIGS. 2 and 3.

By arranging the working air gap in the interior of the coil body, the full magnet flux is conducted through the working air gap when the relay is excited, so that substantially no scatter flux components are lost. This is indicated by the dot and dash line in FIG. 2 identifing a flux path Φ.

Due to the slanted design of the pole or flux guidance faces at the pole shoe 10*a* (or 20*a*) and at the armature end 9*b* (or 19*b*) transmission of magnetic flux Φ is achieved over a larger cross-section with a lower magnetic resistance than with flux guidance surfaces proceding substantially parallel to the coil axis. The length "a" (indicated in FIG. 3) of the pole faces can be set as desired by a corresponding dimensioning of the pole show 20*a* (or 10*a*) and of the armature end 19*b* (or 9*b*).

Figure 4:
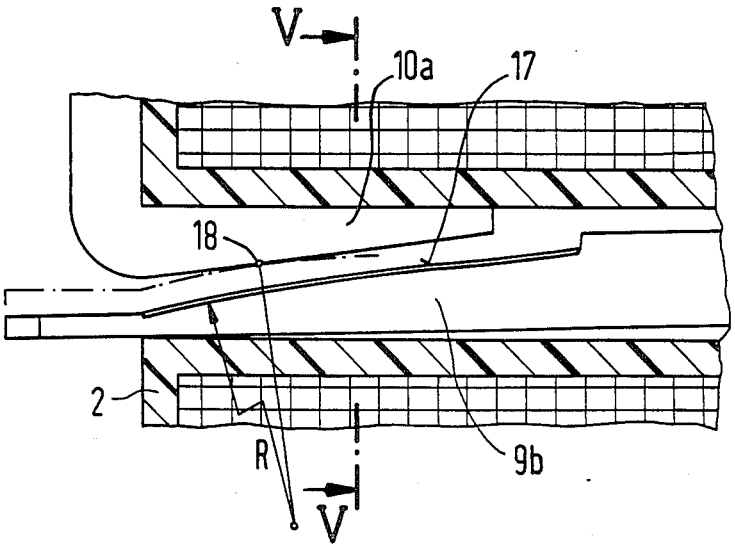
FIG. 4 is an enlarged side view, partly in section, of the working air gap in the electromagnetic relay of the present invention.
Figure 5:
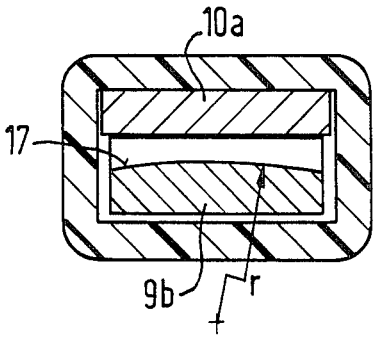
FIG. 5 is an enlarge cross-sectional view of the working air gap taken along line V—V of FIG. 4.

In order to create defined response conditions and in order to compensate for positional tolerances, in a further embodiment of the relay at least one of the faces of the pole shoes is convex. Such a shaping is shown in enlarged detail FIGS. 4 and 5. In FIG. 4, the pole face 17 on the armature section 9*b* is convex about a radius R. In this embodiment, the armature section 9*b* comes into contact with the pole shoe 10*a* at a point 18 when switching. The position of the attracted armature is indicated with dot and dash lines. In order to achieve a punctiform seating of the armature 9, the armature section 9*b* is also slightly arced in the transverse direction, the pole face 17 having a radius r in this direction, as shown in FIG. 5.

In order to match the force/path conditions between the contact spring and the magnet system, the size of either or both of the pole shoe faces can be optimized by modifying the length of the pole shoe 10*a* or the armature section 9*b*. This is also true of the position of the contact point 18. When the point 18 is moved closer in the direction toward the coil flange 2 (toward the left in FIG. 4) the effective lever arm for a given attractive force is increased in proportion to the distance of the point 18 from the bearing point of the armature 9. The armature attraction force, that is, the current necessary for excitation of the relay, can thus be selected smaller for obtaining a predetermined contacting force.

Although modifications and changes may be suggested by those skilled in the art it is the intention of the inventor to embody within the patent warranted hereon all changes and modifications as reasonably and properly come within the scope of their contribution to the art.

I claim as my invention:

1. An electromagnetic relay comprising:

a coil body having an axial opening extending therethrough with a coil wound thereabout having a longitudinal coil axis;

a yoke having a first section extending into said axial opening having a pole face, a second section extending perpendicularly to said coil axis at one end of said coil, and a third section extending parallel to said coil axis outside of said coil to an opposite end of said coil;

an armature extending through said axial opening along a full longitudinal length of said coil having a free end with a pole face forming a working air gap with said pole face of said first yoke section, said pole faces being obliquely disposed relative to said coil axis, and said free end having a projection extending out of said axial opening;

means for pivotally mounting said armature disposed outside of said coil permitting movement of said free end in directions perpendicular to said coil axis;

at least one stationary contact element; and a contact spring disposed for directly engaging said projection of said armature for co-movement therewith for electrical connection and disconnection with said stationary contact element.

2. An electromagnetic relay as claimed in claim 1, wherein said means for pivotally mounting said armature is an armature leg extending perpendicularly to said coil axis and having a bearing recess receiving an end of said third yoke section at said opposite end of said coil.

3. An electromagnetic relay as claimed in claim 1, wherein said means for pivotally mounting said armature is a fourth section of said yoke extending perpendicular to said coil axis at said opposite end of said coil having a bearing recess in which said armature is received.

4. A relay as claimed in claim 1, wherein at least one of said pole faces is shaped for forming a point contact with the other of said pole faces.

5. A relay as claimed in claim 1, wherein said one of said pole faces is convexly arced in at least one direction.

6. An electromagnetic relay as claimed in claim 5, wherein said one of said pole faces is convexly arced along said coil axis.

7. An electromagnetic relay as claimed in claim 5, wherein said one of said pole faces is convexly arced in a direction perpendicular to said coil axis.

8. An electromagnetic relay as claimed in claim 5, wherein said one of said pole faces is convexly arced both along said coil axis and perpendicular to said coil axis.

* * * * *